United States Patent [19]

Anderson

[11] 3,981,027

[45] Sept. 21, 1976

[54] FOOTBALL SHOULDER PAD RESTRICTER

[76] Inventor: George C. Anderson, 2883 Doidge Ave., Pinole, Calif. 94564

[22] Filed: June 19, 1975

[21] Appl. No.: 588,213

[52] U.S. Cl. ..... 2/2
[51] Int. Cl.[2] ..... A41D 13/00
[58] Field of Search ..... 2/2, 45

[56] References Cited

UNITED STATES PATENTS

| | | | |
|---|---|---|---|
| 2,545,039 | 3/1951 | Mitchel | 2/2 |
| 3,158,871 | 12/1964 | Morgan | 2/2 |
| 3,366,970 | 2/1968 | Morgan | 2/2 |
| 3,431,560 | 3/1969 | Austin | 2/2 |
| 3,740,763 | 6/1973 | Mitchell | 2/2 |

*Primary Examiner*—Werner H. Schroeder
*Attorney, Agent, or Firm*—Harry A. Pacini

[57] ABSTRACT

Improved football shoulder pads having a restricter comprising rigid or semi-rigid inserts movably mounted each to the breast plates and back plates of shoulder pads worn by football players, which restrict the shoulder pads from putting pressure on the neck of the wearer when reaching in front of the body or above the head, as when catching a pass.

9 Claims, 4 Drawing Figures

FOOTBALL SHOULDER PAD RESTRICTER

BACKGROUND OF THE INVENTION

This invention relates to an improved shoulder pad assembly as worn by football players. More particularly, this invention relates to a new and improved rigid or semi-rigid restricter insert movably mounted between the breast plates and back plates of said shoulder pad assembly.

As the popular game of football has evolved, protective equipment for the players has become a necessity. Whether football as a game played in high schools, colleges or as professionals, each player wears heavy and expensive protective equipment. Plastic or leather headguards, such as helmets, are mandatory. Pads are used to protect thighs, shoulders and kidneys. Heavy shoulder pads now worn by football players produce a substantial handicap for the ball handler and receiver.

The existing shoulder pad assemblies worn by football players as part of their required protective equipment employ adjustable lacings on the front and back between the breast plates and back plates. Each type of shoulder pad worn by football players is large and bulky. They are constructed in portions of overlapping contoured segments so as to conform to the anatomy of the athlete who wears it. The lacings are used to secure or adjust the pads. With the lacings there is considerable amount of transverse flexibility in the movement of the shoulder pad assembly. Unfortunately, the movement of the shoulder pads is often detrimental to the performance of the athlete wearing the shoulder pads.

Since the body arches of the shoulder pad assembly fit closely around the neck of the athlete, it is noted that when the wearer attempts to reach in front of his body, the shoulder pad assembly acts to restrict this movement. Also, as the athlete attempts to reach above his head, as in catching a pass, the shoulder pads are noted for movement toward and around the athlete's neck. This latter effect is unpleasant and can be painful. Thereby, the athlete is prevented from successfully completing his task of catching the football. Complete control and freedom of movement by the athlete is highly desirable.

Shoulder pad equipment which permits freedom of movement and decreases possible injury to the wearer during certain movements is desirable. Also desirable is a usable shoulder pad of reasonable design incorporating a suitable device to decrease possible injury to the wearer.

It must be appreciated that existing football shoulder pads as described do not provide for sufficient restriction to prevent choking or putting uncomfortable pressure on the neck of the athlete wearing the device.

U.S. Pat. No. 2,545,039 relates to prior disclosure of a shoulder pad device, which includes a means for connecting shock-absorbing arches by a semi-rigid plate or connecting member. There is no provision in the prior art for slidable movement of the shoulder pad assembly along the passageways formed by slots in the connecting member. Further, U.S. Pat. No. 3,166,760 describes shoulder pad construction having a rigid connecting plate of relatively stiff spring steel or other such material. Similarly, there is no provision in the prior art football pad devices for movable mounting of a connecting insert.

SUMMARY OF THE INVENTION

Objects of the present invention are to provide for an improved football shoulder pad assembly which permits and provides for the freedom of movement of the wearer without physical discomfort during certain movements of the wearer.

Another object of the present invention is to provide an improved football shoulder pad assembly which permits and provides for restricted movement of the pad assembly thereby allowing the wearer to move more freely.

Another object of the present invention is to provide a rigid or semi-rigid restricter insert movably joining each the breast plates and back plates of the body arches of a football shoulder pad assembly.

Other objects and features of the invention will become more apparent from the following description when considered with the following drawings in which.

DETAILED DESCRIPTION OF THE INVENTION

In the following description and in the claims, various details will be identified by specific names for convenience, but they are intended to be generic in their application as the art permits.

Like reference numbers and characters denote like parts in the several figures of the drawings.

In the accompanying drawings and description forming part of this specification, certain specific disclosure of the invention is made for purposes of explanation, but it will be understood that the details may be modified in various respects without departure from the broad aspects of the invention. The description of the shoulder pad structure is not given in great detail in view of the fact that this portion of the structure is generally conventional, and details of the construction may be varied without changing the present invention.

Figure 1:
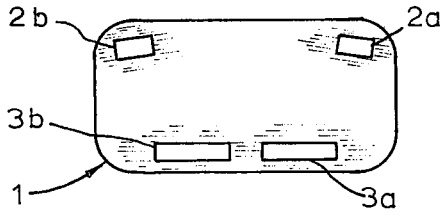
FIG. 1 is a planar view of the breast or front rigid or semi-rigid restricter insert.
Figure 2:
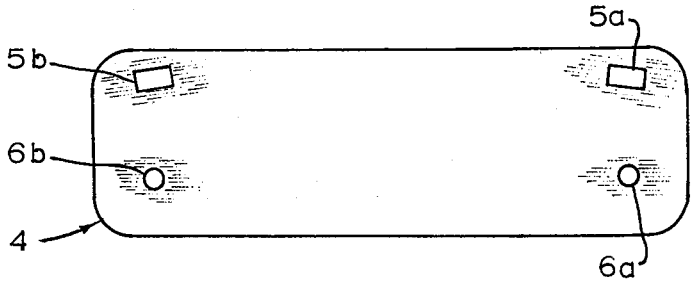
FIG. 2 is a planar view of the back rigid or semi-rigid restricter insert.

Reference now is made to the accompanying drawings and more particularly to FIGS. 1 and 2 which are planar views of the rigid or semi-rigid restricter inserts with required slots and holes for mounting and movement. For more complete and specific embodiments of this invention, reference is also made to FIGS. 3 and 4.

Shoulder pad assemblies are constructed of various portions or segments, connected together by various means for hinging, such as with web hinges and the like. Epaulets and shoulder caps protect the outer shoulder extremities. These are laid over body arches 8*a*, 8*b*, 9*a*, and 9*b*, which extend from front to back and rest on the shoulders. The body arches, chest or breast plates, extend slightly down on the chest in front 8*a* and 8*b*, and down on the upper back in the back 9*a* and 9*b*, back plates. Body straps are usually provided to adjust and secure the shoulder pad assembly on the athlete's body. On each part of the shoulder pad assembly there is a protective underlayer of padding, preferably of a foam-type material to cushion the body from the rigid portions of the shoulder pad assembly.

As illustrated, the improvement in the construction of shoulder pad assembly of this invention comprises a front insert 1 between the breast plates 8*a* and 8*b* of the body arches and a back insert 4 between the back plates 9*a* and 9*b* of the body arches. In all respects, the football pad assembly is standard except for the improvement of this invention and the improved and heretofore unknown restricter inserts.

The front restricter insert 1 is constructed of rigid or semi-rigid material, such as plastic, firm rubber or light metal. The front restricter insert 1, having a substantially rectangular shape, has a pair of elongated slots 3*a* and 3*b* equipositioned along its lower edge. In the top portion of the front insert 1 are a pair of angled slots 2*a* and 2*b*. The angled slots are positioned substantially near the corners of the inert. The operation of the pair of elongated slots 3*a* and 3*b*, as well as the pair of angled slots 2*a* and 2*b* will become more evident hereinafter.

The back restricter insert 4, also having a substantially rectangular shape, is longer than the front insert, because the distance it must span is joining the back body arches 9*a* and 9*b* is greater than the front distance for the front insert 1. In the construction of the back insert 4, there is provided a pair of holes 6*a* and 6*b* through the insert 4 along the lower edge. Also provided for is a pair of angled slots 5*a* and 5*b* each in the upper corner area of the insert. The material of construction for the back insert 4 is similar to the front insert1. Preferred is heavy one-eighth to one-fourth inch rigid plastic. The size of the front 1 and back 4 insert restricters will depend upon the size and preference of the athlete wearing the shoulder pad assembly. Therefore, the shoulder pad assembly will determine the size of the restricters. However, with the slot arrangement as provided in the front and back insert restricter 4, there is allowed some horizontal movement for shoulder pad positioning and size adjustment.

Figure 3:
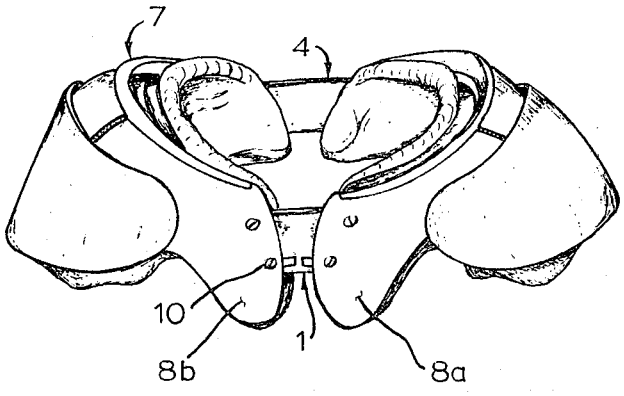
FIG. 3 is a front view of a football shoulder pad assembly with the breast or front rigid or semi-rigid restricter insert in place between the front plates of the body arches.

With reference to FIG. 3, the front insert restricter 1 is positioned between the front body arches 8*a* and 8*b*, such that the elongated slots 3*a* and 3*b* are at the bottom and the angled slots 2*a* and 2*b* are at the top. The front insert restricter 1 is held in place by a means for mounting 10, such as rivets, capped screws or bolts, and the like. Each mounting means 10 cooperates with and communicates with each of the four slots 2*a*, 2*b*, 3*a* and 3*b* in the front insert restricter 1. Similarly, with reference to FIG. 4, the back insert restricter 4 is positioned between the back body arches 9*a* and 9*b*, such that the angled slots 5*a* and 5*b* are at the top and the holes 6*a* and 6*b* are on the bottom. The back insert restricter 4 is held in place by means for mounting 11, such as rivets, capped screws or bolts and the like. Each mounting means 11 cooperates with and communicates with said angled slots 5*a* and 5*b* and holes 6*a* and 6*b* in the back insert restricter 4.

The insert restricters 1 and 4 are not rigidly mounted, but are securely mounted in the shoulder pad assembly. However, the body arches 8*a*, 8*b* (front) and 9*a* and 9*b* (back) are restrictedly pivotal with respect to the inserts 1 and 4 and are permitted some differential and restricted movement as defined by the slots and the holes as described hereinabove. By communicating with the slots, restricted movement along the passageway formed by the slot is possible. Similarly, the holes 6*a* and 6*b* in the back insert restricter 4 permits restricted pivotal movement of the back body arches 9*a* and 9*b*. Only the slots 5*a* and 5*b* in back insert restricter 4 allow movement, while holes 6*a* and 6*b* allow only pivotal movement transverse to the axis of the fastening means 11.

Figure 4:
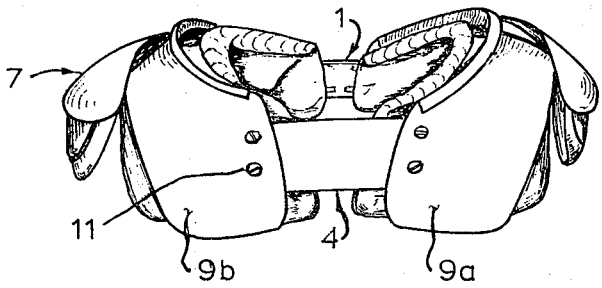
FIG. 4 is a back view of a football shoulder pad assembly with the back rigid or semi-rigid restricter insert in place between the back plates of the body arches.

The principle upon which the invention is based, as well as the operation of the restricters, will be best understood by referring to FIGS. 3 and 4. FIGS. 3 and 4 represent the front insert restricter 1 and back insert restricter in position. When the athlete wearing the improved shoulder pads of this invention raises his arms, the epaulets, shoulder caps and body arches 8*a*, 8*b*, 9*a* and 9*b* move inwardly toward the neck of the athlete. However, because of the restricted movement of the fastening means 10 and 11, the body arches are not permitted to choke or otherwise put pressure on the neck of the wearer. The movement is constrained, from making any but a desired, predetermined motion. Said motion is regulated by the position and length of the slots according to this invention in the front 1 and back 4 insert restricters cooperating with the fastening means 10 and 11. At the same time, the shoulder pad assembly is restrained from moving in a pinching or choking action about the neck of the athlete wearing the assembly. The rest position for the improved shoulder pad assembly is attained by relaxing or lowering the arms of the athlete. When the arms and shoulders of the athlete are in their normal carriage, the shoulder pad assembly functions as a conventional shoulder pad.

The improved shoulder pad assembly can be put on by the wearer by slipping the assembly over his head. Also contemplated are easily attachable and detachable insert restricters in cooperation with suitable attachable and detachable fastening means having posts or shanks to cooperate with slots 2*a*, 2*b*, 3*a*, 3*b*, 5*a* and 5*b*, and holes 6*a* and 6*b*.

By using the present invention, it is thus possible to have a convenient, lightweight and effective means for restricting the movement of a football shoulder pad assembly and thereby to eliminate discomfort caused to the wearer when the shoulder pads choke or put unpleasant pressure on the neck of the wearer. The rigid or semi-rigid inserts in front and in back between the body arches are novel in design and in the restricters movement they impart to the football shoulder pad assembly. Acting together, the inserts form the basis for an original and useful improvement in the design, function and operation of football shoulder pads.

The restricted movement along the passageways formed by the slots and holes in the inserts is of primary importance, as it is essential to allow some movement of the shoulder pads and at the same time restrict the body arches from injuring the wearer. In a structure of this type, although a direct comparison between the present construction and conventional structures is difficult, it is the opinion of football players who have used shoulder pads equipped with the present invention that they are capable of performing as described hereinabove.

While certain novel features of the invention have been disclosed herein, and pointed out in the annexed claims, it will be understood that, in accordance with the doctrine of equivalents, various omissions, substitutions and changes may be made by those skilled in the art without departing from the spirit of the invention.

What is claimed is:

1. In football shoulder pads having epaulets, shoulder caps, body arches over each shoulder extending from front to back forming a pair of breast plates and a pair of back plates, means for hinging the various segments, body strap means for adjusting said shoulder pads, and a protective underlayer of padding, the improvement comprising a front restricter insert positioned between said breast plates having a substantially rectangular shape, a pair of elongated horizontal slots equipositioned adjacent the lower edge of said front restricter insert, a pair of angled slots relative to said slots adjacent the lower edge each positioned adjacent the upper corners of said insert, and a back restricter insert positioned between said back plates having a substantially rectangular shape and relatively longer than said front restricter, a pair of holes adjacent along the lower edge, a pair of angled slots each positioned adjacent the upper corner areas of said insert each insert slidably mounted to said breast plates and back plates with mounting means, said mounting means cooperating with and communicating with said slots and said holes of said front restricter insert and said back restricter insert.

2. The improvement of claim 1 in which said slots in the upper corner area adjacent the upper edge of the back restricter insert are slightly angled relative to said slots adjacent the lower edge.

3. The improvement of claim 1 in which said front and back restricters are constructed of semi-rigid material.

4. The front and back restricters of claim 3 in which said semi-rigid material is plastic.

5. Restricters for football shoulder pads comprising substantially rectangular inserts one each for front and for back slidably mounted between breast plates and back plates of said football shoulder pads, said back insert relatively longer than said front insert, each of said front and back restricter with angled slots adjacent the upper corners and in said back plate round holes adjacent to the lower edge to cooperate and communicate with means for mounting said inserts to said breast plates and back plates, to permit restricted movement along the passageways formed by said slots and holes, whereby the football shoulder pad is restricted from choking the wearer.

6. Restricters as claimed in claim 5 wherein said inserts are formed of rigid plastic.

7. Restricters as claimed in claim 5 wherein said inserts are formed of semi-rigid material.

8. Restricters as claimed in claim 5 wherein the breast plate insert has a pair of elongated slots equipositioned along the adjacent lower edge of said insert and a pair of slots angled relative to said slots adjacent the lower edge each adjacent the corners of said insert.

9. Restricters as claimed in claim 5 wherein the back plate insert has a pair of holes through said insert adjacent the lower edge and a pair of angled slots relative to the adjacent edge each in the upper corner area of said insert.

* * * * *